United States Patent [19]

Reed, Jr.

[11] Patent Number: 4,661,892

[45] Date of Patent: Apr. 28, 1987

[54] ELECTRICAL PLUG AND RECEPTACLE FOR LIGHTING FIXTURE POWER HOOK

[75] Inventor: Gueary T. Reed, Jr., Lee, Miss.

[73] Assignee: Emerson Electric Co., St. Louis, Mo.

[21] Appl. No.: 749,991

[22] Filed: Jul. 1, 1985

[51] Int. Cl.[4] ..... H01R 33/00

[52] U.S. Cl. ..... 362/226; 362/396; 339/122 F; 339/120; 339/91 R

[58] Field of Search ..... 362/396, 226, 404; 339/122 R, 122 F, 126 RS, 128, 91 R, 123, 135, 120, 119, 147 R, 147 P; 337/198

[56] References Cited

U.S. PATENT DOCUMENTS

| | | | |
|---|---|---|---|
| 593,853 | 11/1897 | Paiste | 339/197 R |
| 1,883,621 | 10/1932 | D'Olier | 339/120 X |
| 1,924,902 | 8/1933 | Barnett | 337/198 |
| 2,273,167 | 2/1942 | Anderson | 339/135 X |
| 2,349,924 | 5/1944 | Anderson | 362/404 X |
| 2,711,522 | 6/1955 | Goodwin | 339/126 RS |
| 2,942,227 | 6/1960 | Hjelseth | 339/120 X |
| 2,988,725 | 6/1961 | Vallee | 339/126 RS |
| 3,104,925 | 9/1963 | MacNamara | 339/126 RS |
| 3,302,918 | 2/1967 | Cohen | 362/404 X |
| 3,387,253 | 6/1968 | Salners et al. | 339/126 RS |
| 4,099,223 | 7/1978 | de Vos et al. | 362/226 |
| 4,378,584 | 3/1983 | Russello | 362/396 |

FOREIGN PATENT DOCUMENTS

| | | | |
|---|---|---|---|
| 519350 | 12/1955 | Canada | 362/226 |
| 1211987 | 3/1960 | France | 337/198 |

*Primary Examiner*—Carroll B. Dority, Jr.

*Attorney, Agent, or Firm*—Polster, Polster and Lucchesi

[57] ABSTRACT

A power hook for suspending a lighting fixture from an overhead support and for supplying power to the lighting fixture is disclosed. The power hook includes a support housing which is securable from the overhead support, with the housing having an eye and hook support arrangement on the bottom thereof for the removable attachment of a lighting fixture, such as a high pressure sodium luminaire. A power plug housing is removably securable to the support housing without the requirement of tools, and the support housing has a plug receptacle carried thereby facing toward the power plug housing when the latter is attached to the support housing. The power plug housing has a male power plug carried thereby for being received within a power receptacle carried by the support when the plug housing is secured to the support housing, and a flexible power lead is connected to the male plug and to the lighting fixture for supplying power to the lighting fixture. A female receptacle carried by the support housing, with the femal receptacle having a body of electrically insulative synthetic resin material, a pair of power leads, and a ground lead molded in place within the receptacle body. The receptacle body is so designed as to snap-fit into an aperture provided in the support housing thereby to hold the receptacle body in place.

2 Claims, 10 Drawing Figures

FIG. 4
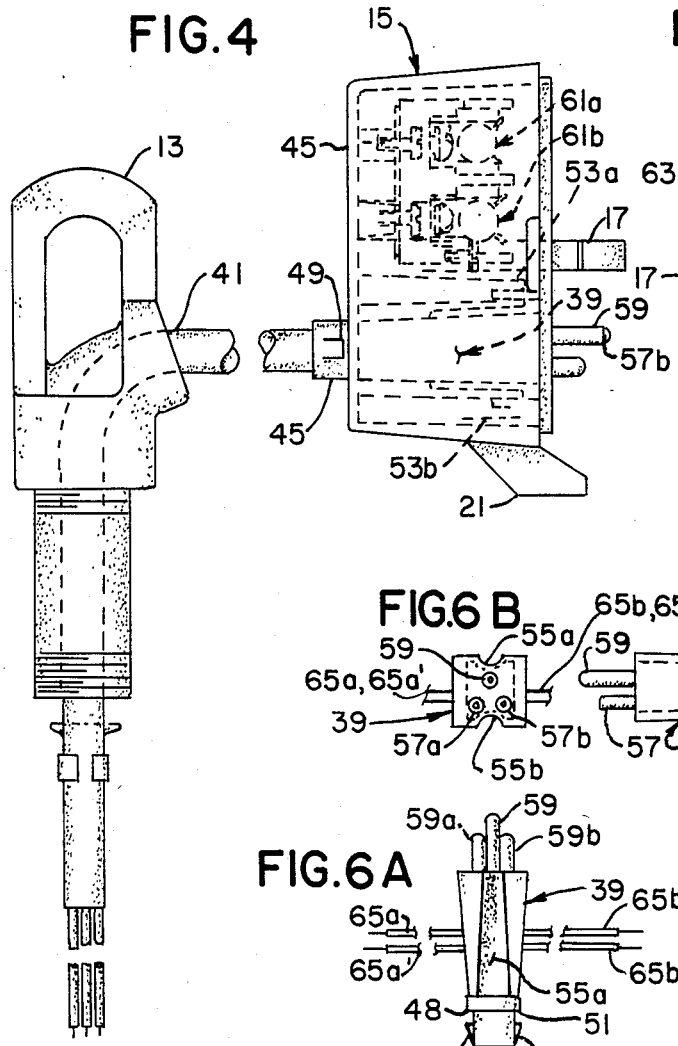
FIG. 5.
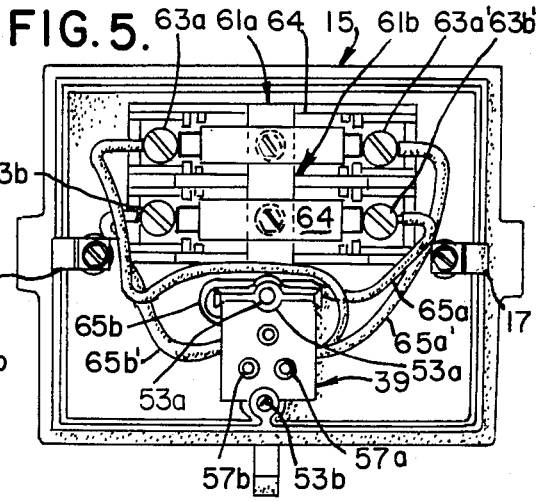
FIG. 6 B
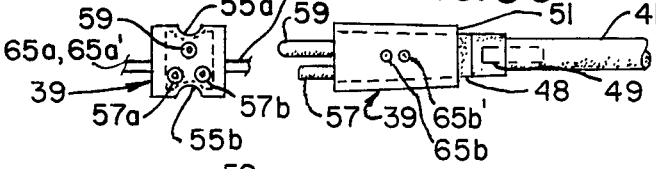
FIG. 6 C
FIG. 6 A
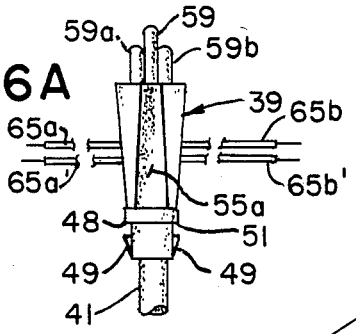
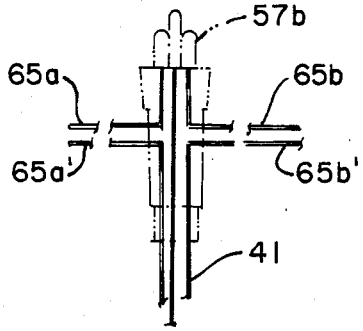
FIG. 7.
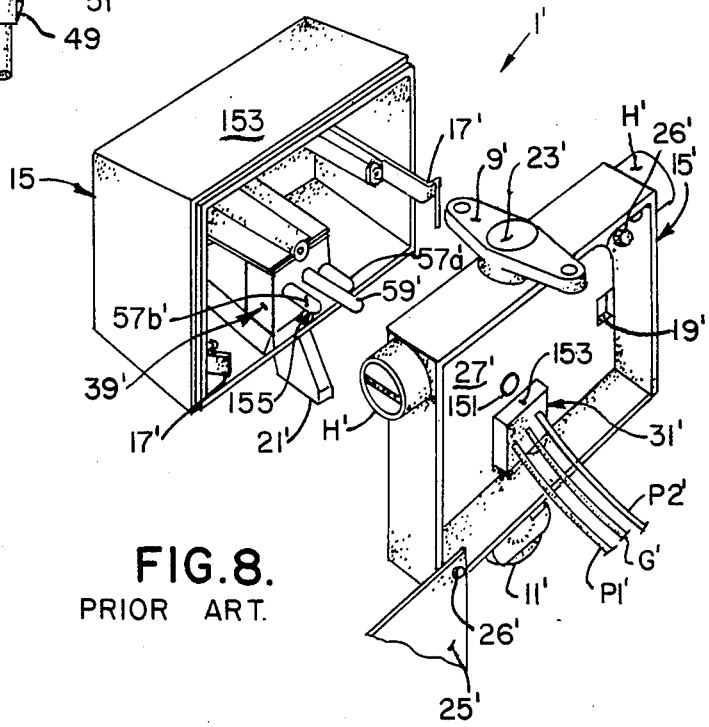
FIG. 8.
PRIOR ART.

ELECTRICAL PLUG AND RECEPTACLE FOR LIGHTING FIXTURE POWER HOOK

BACKGROUND OF THE INVENTION

This invention relates to a so-called lighting fixture power hook and, more particularly, to an electrical plug and receptacle for such a lighting fixture power hook.

In many lighting applications, particularly in industrial buildings or the like, it is conventional to utilize luminaires supported from the overhead ceiling or roof structure within the building at predetermined spaced intervals for general purpose lighting throughout the building. Typically, these luminaires include a ballast assembly for powering a metal halide or high pressure sodium vapor lamp.

So-called power hooks have been utilized to suspend the luminaires together with their ballasts from an overhead ceiling or roof structure and so as to supply electrical power to the ballast of the luminaire for energizing the lamps. These prior power hooks included a support housing which may be secured, via a conduit or the like, to the overhead roof or ceiling structure. A hook is typically provided on the bottom of the support housing, and an eye is provided on the top end of the luminaire or the luminaire ballast which is received by the hook on the support housing for universally supporting the luminaire, and so as to permit universal movement of the luminaire relative to the support housing thereby to ensure that the luminaire hangs in a substantially vertical position. Power lines are usually run into the support housing via an appropriate conduit which may also serve as the support for the support housing. The support housing also includes hubs on each side thereof through which through wiring may be run so as to interconnect a number of the luminaires in parallel with one another. A power housing is typically removably secured to the support housing, with the support housing including a female electrical receptacle, and with the power housing including a male plug. The male plug carried by the power housing is interconnected, via a flexible lead, to the luminaire. When the power housing is snapped in place on the support housing, a male electrical plug is received by the power receptacle in the support housing so as to supply power to the luminaire. In this manner, the luminaire can be readily electrically disconnected and removed from the support housing by removing the power housing from the support housing, and by lifting the luminaire from the hook on the support housing. A new luminaire may be readily installed by hanging the luminaire from the hook and by plugging its power housing into the support housing thereby to electrically connect the new luminaire to the support housing.

While the prior power hooks worked well for their intended purposes, both the female power receptacle in the support housing and the male plug in the power housing require that these receptacles and plugs be individually installed in their respective housing, and that they have both power leads and ground leads soldered to the respective terminals thereof. It will be appreciated that, particularly, with the leads in place, it was somewhat difficult to install the respective plug or receptacle in the housing. Additionally, with the leads soldered to the receptacle or plug, and with the requirement of fastening the respective leads to grounding screws or connecting the leads to fuses which may optionally be housed within the power housing, undue strain would sometimes be placed on the respective connections of the lead wires to the plugs or receptacles. It has been known that the lead wires of such prior art receptacles and plugs would, on occasion, break at the receptacle or plug terminal, thus requiring repair.

Thus, there has been a long-standing need to overcome the requirement of plugs and receptacles which have soldered-in-place lead wires, and which must be screwed or otherwise fastened into the support housing and into the power housing.

SUMMARY OF THE INVENTION

Among the several objects and features of the present invention may be noted the provision of an electrical plug and receptacle for a lighting fixture power hook, such as above-described, in which the electrical receptacle in the support housing, and the electrical plug in the power housing may be readily snapped into position within their respective housings without the necessity of other fasteners;

The provision of such a power hook in which the electrical leads for both the receptacle and the plug need not be soldered to terminals on the receptacle or on the plug;

The provision of such a power hook in which auxiliary leads may extend outwardly from the plug body in the power housing for ready connection to optional internal fuses carried within the power housing;

The provision of such a power hook in which the plug will reliably make and break contact with the receptacle upon installing and removing the power housing on and from the support housing; and The provision of such a power hook which reduces labor for assembly thereof, which is of rugged construction, which permits in-line fuses to be readily utilized, which has rugged strain relief of lead wires, and which substantially reduces manufacturing costs.

Briefly stated, in a power hook for suspending a lighting fixture from an overhead source and supplying power to the lighting fixture, the power hook comprises a support housing having means for securement thereof to an overhead support. The support housing has, on the bottom thereof, one member of an eye and hook support arrangement for the removable attachment of the lighting fixture to the support housing. The lighting fixture is supported by another portion of eye and hook arrangement carried thereby so as to be substantially universally swivelable so as to assume a generally vertical operating position. A power plug housing is removably secured to the support housing. This support housing has an electrical receptacle carried thereby facing toward the plug housing when the latter is attached to the support housing. The power plug housing has a power plug carried thereby for being received by the receptacle when the power plug housing is secured to the support housing. The power plug has a flexible power lead connected thereto which is also connected to the lighting fixture for supplying electrical power to the lighting fixture. More specifically, the improvement of this invention comprises a female receptacle having a body of electrically insulative synthetic resin material, a pair of power leads, and a ground lead molded in place within the receptacle body. The receptacle body further has means for snap fitting into an aperture provided in the support housing so as to hold the receptacle body in place with respect to the support housing. A male plug is provided within the power housing, the male plug having a plug body of electrically insulative synthetic resin material, a pair of male terminals, and a male ground terminal extending therefrom. The plug body snap fits into an aperture provided in the power plug housing so as to securely hold the plug body in place with respect to the power plug housing. The male power and ground terminals extending from the plug body are received within the receptacle for making electrical contact therewith upon fitting the power plug housing onto the support housing.

BRIEF DESCRIPTION OF THE DRAWINGS

FIG. 4 is a side elevational view of the power plug housing and of the eye support fixture for supporting the light fixture;

FIG. 5 is a right side elevational view of the power plug housing shown in FIG. 4;

FIGS. 6A–6C illustrate the top, front, and side elevational views of the unitary plug housing, fitted into the power receptacle in accordance with this invention;

FIG. 7 is an electrical schematic view of the plug body having auxiliary leads extending from the sides thereof for connection to in-line fuses, optionally provided in the power housing; and FIG. 8 is a view similar to FIG. 2, showing prior art electrical receptacles and plugs with soldered-in-place lead wires.

Corresponding reference characters indicate corresponding parts throughout the several views of the drawings.

DESCRIPTION OF A PREFERRED EMBODIMENT

Figure 1:
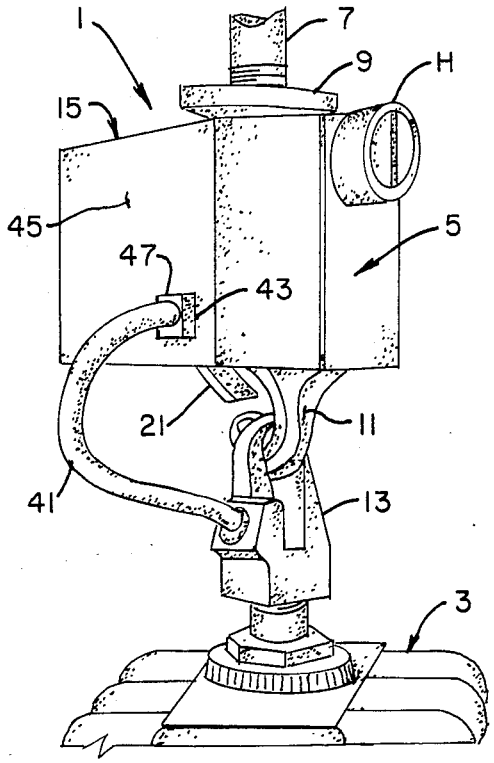
FIG. 1 is a perspective view of a power hook of the present invention, supporting a luminaire.

Referring now to the drawings, and more particularly to FIG. 1, a power hook is indicated in its entirety by reference character 1, for universally swivelably supporting a lighting fixture (e.g., a luminaire) 3 from an overhead support, such as the ceiling or roof structure of a building or the like. More specifically, power hook 1 includes a support housing 5 constituted by a unitary casting of aluminum or other suitable metal alloy. A support conduit 7, extending downwardly from the above-noted overhead support structure, is threaded or otherwise fastened to a support collar 9 integral with support housing 5. In this manner, support housing 5 may be positively secured to the overhead structure (not shown) of the building by the support conduit 7. The support housing 5 has a hook 11 integral on the lower face of the support housing, generally in axial alignment with support conduit 7. Luminaire 3 has a closed eye 13 at the top thereof, which hooks onto hook 11 so as to universally, swivelably support light fixture 3 on hook 11 of support housing 5. While hook 11 is shown to be carried by the support housing, and while eye 13 is shown to be carried by the luminaire 3, it will be understood that an eye may be provided on the bottom of support housing 5 in place of hook 11, and that a hook (not shown) may be provided on the top of luminaire 3 in place of eye 13. It is also permissible to use hooks on both the light fixture 3 and the support housing 5.

Figure 2:
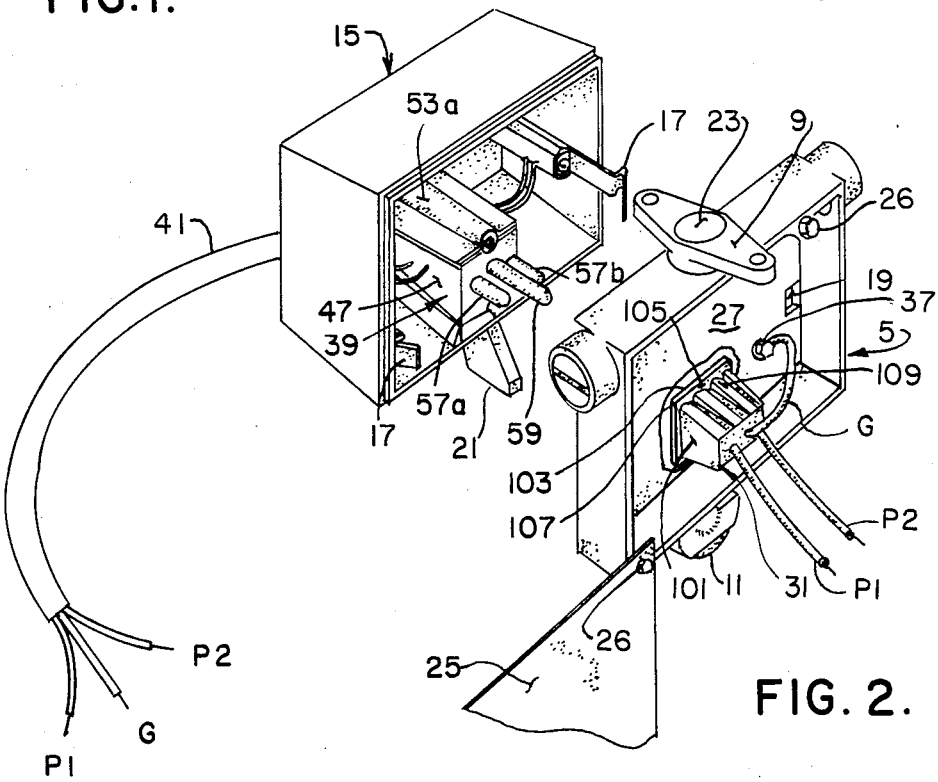
FIG. 2 is an exploded perspective view of the power hook of the present invention, showing a one-piece molded receptacle snap-fitted into place within an aperture in the support housing, and further showing a one-piece molded plug body snap-fitted into place within an aperture in the power housing.

Power hook 1 further includes a power plug housing, as generally indicated at 15, which is adapted to fit onto and to be in engagement with one face of support housing 5. A pair of spring latches 17 (as best shown in FIGS. 2, 4, and 5) engage latch openings 19 in the face of support housing 5 facing generally toward power plug housing 15, with the spring latches positively holding power plug housing 15 in generally face-to-face engagement with support housing 5. A safety stop 21 protrudes downwardly from the center of the bottom of power plug housing 15 so as to overlie the upper portion of eye 13 of luminaire 3 when the eye 13 is hooked on hook 11 thereby to prevent upward movement of the eye 13 relative to hook 11, and so as to prevent the eye 13 from being inadvertently disengaged from hook 11. However, it will be understood that luminaire 3, as supported on hook 11 by eye 13, may substantially universally swivel about any axis on the hook (within a limited range) so that the luminaire 3 will seek its own equilibrium position so as to hang substantially vertical relative to the power hook.

Figure 3:
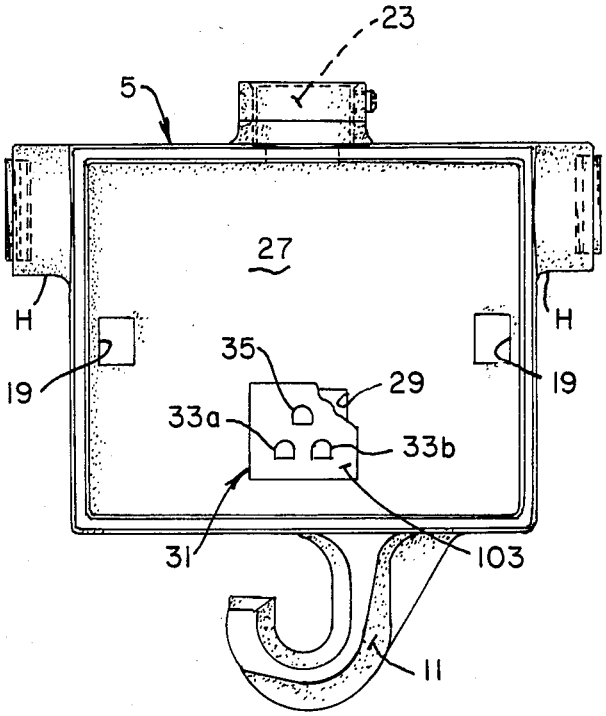
FIG. 3 is a front elevational view of the support housing, illustrating the face thereof on which power plug housing mates.

As shown best in FIG. 2, support collar 9 includes a power line opening 23, having female threads therein into which support conduit 7 may be threaded such that a power cable (not shown) may be inserted down through the center of conduit 7 so as to enter support housing 5. A removable cover 25 is secured to the back face of support housing 5 by means of screws 26, with the cover being at least partially removable so as to permit access to the interior of the support housing. Support housing 5 has a front face 27 on the side thereof generally toward power plug housing 15, this front face having latch openings 19 therein. A receptacle opening or aperture, as indicated at 29 in FIG. 3, is provided in front face 27 of support housing 5.

In accordance with this invention, a one-piece power receptacle 31, of a suitable synthetic plastic resin material, such as polyvinylchloride (PVC) or the like, is inserted into receptacle opening or aperture 29 in such manner as to be positively held in place relative to front face 27 of support housing 5 such that the power receptacle 31 is substantially prevented against movement in axial direction toward and away from front face 27, and so as to prevent both translational and rotational movement of the power receptacle 31 relative to front face 27. The integrally molded power receptacle 31 has two power leads, as indicated at P1 and P2, and a ground lead G extending therefrom for purposes as will appear. More specifically, receptacle 31 has a pair of power terminal receptacle openings **33*a*, 33*b* spaced apart from one another and connected, respectively, to power leads P1 and P2. Further, receptacle body 31 has a ground terminal receptacle opening 35 therein, with the power terminal receptacles and the ground terminal receptacles being arranged relative to one another in a desired manner so as to receive the male terminals of the mating. Ground wire G is electrically connected to ground receptacle opening 35, and the end of the ground lead G is held in electrical contact with front face 27 of support housing 5 by means of an appropriate ground screw 37 threaded into front face 27**.

More specifically, power receptacle 31 includes a body 101 having a front face 103. Behind the front face, a shoulder 105 is provided which bears against the outer surface of support housing front face wall 27. Body 101 further has a square groove 107 therein, with the groove being somewhat wider than the thickness of front face 27 of support housing 5, and with the front cross sectional area of front face 103 being somewhat larger than aperture 29 in front face 27. Further, on the top and bottom surfaces of the rear portion of body 101, a plurality of deformable ramps or barbs 109 is provided, with these ramps being so sized such that when the body 101 of the compessible sythentic resin material (e.g., polyvinylchloride) is inserted through opening 29, the inclined outer surfaces of the deformable ramps 109 cause the ramps 109 to at least in part deform or compress thereby to permit the body 101 to be forced through opening 29. As groove 107 comes into register with opening 29, body 101 will snap-fit into place such that the body is positively held captive in axial direction within opening 29 by shoulder 105 on front face 103, and by the inner ends of the deformable ramps 109. In this manner, body 101 may be inserted into opening 29 without the use of fasteners or tools, and yet the body 101 is positively held in axial position, is held against rotation (due to the square cross section of body 101 and aperture 29), and is prevented from substantial translation in the plane of body face 27 by the close fit of aperture 29 to the portion of body 101 defining the base of groove 107.

It will be understood with cover 25 at least partially removed from support body 5, power lines P1 and P2 may be readily connected to the power inlet lead extending downwardly through support conduit 7 (or extending laterally into support housing 5 by means of side hubs H on the sides of support body 3). Of course, the power leads P1 and P2 may be connected to the power supply wiring by means of wire nuts or the like in the conventional manner.

Referring now to FIGS. 2, 4, 5, and 6A–6C, a molded power plug, as generally indicated at 39, is shown to be affixed to a flexible power cord 41 extending from power plug housing 15 to luminaire 3 thereby to supply electrical power to the luminaire. A square aperture 43 (see FIG. 1) is provided in the rear wall 45 of power plug housing 15. Molded power plug 39 includes a plug body 47 molded of a suitable electrically insulative synthetic resin material, such as polyvinylchloride, which is at least, in part, compressible. The rear or outer end of plug body 47 is of square cross section, and the portion thereof, as indicated at 48 (as best shown in FIGS. 6A and 6C) has a close fit with square aperture 43 in the rear or outer wall 45 of power plug housing 15. The rear end of the plug body 47 has a plurality of compressible ramps or barbs 49 which, when inserted through square aperture 43 from the inside of power plug housing 15, are at least partially compressed. When the edges of wall 45 defining square aperture 43 move into register with the square cross section portion 48 of plug body 47, the plug body 47 is positively held captive between the compressible barbs or ramps 47 and a shoulder 51 provided on the plug body.

As best shown in FIG. 5, power plug housing 15 is a one-piece casting of suitable aluminum alloy or the like, and has a pair of spaced bosses 53*a*, 53*b* extending inwardly toward support housing 5 from the back wall 45 of the power plug housing. Correspondingly, grooves 55*a*, 55*b* are provided in plug body 47 so as to accommodate bosses 53*a*, 53*b*, and such that the plug body 47 (see FIG. 5A) is tightly held captive between bosses 53*a* and 53*b* when the plug body 47 is inserted from the open face of power plug housing 15 into the square aperture 43 in rear wall 45 of the power plug housing such that the compressible barbs 49 snap into place, thus positively holding the plug body relatively to power plug housing 15. It will be appreciated that shoulder 51 and barbs 49 substantially positively prevent axial in and out movement of the plug body with respect to power plug housing 15 and that the square cross section 48 of the plug body prevents rotation and translation due to its bearing against the edges of wall 45, which form square aperture 43. Molded plug 39 includes power terminals 57*a*, 57*b* which are connected respectively to power lines P1 and P2 in flexible power cord 41, and a male grounding terminal 59 is connected to a ground lead G in power cord 41, with the other end of the power cord 41 being connected to appropriate terminals or leads within luminaire 3 in the conventional manner.

As shown best in FIGS. 4 and 5, power plug housing 45 may optionally contain or house one or more fuse assemblies, as indicated at 61*a*, 61*b*. Each of these fuses includes fuse terminals 63*a*, 63*a'* and 63*b*, 63*b'*. Conventional fusable fuse links 64 are carried within each of the fuse assemblies 61*a*, 61*b*.

In accordance with this invention, one or more pairs of fuse wires 65*a*, 65*a'*, 65*b*, 65*b'* extend laterally outwardly from plug body 47 of molded power plug 39 for connection to respective fuse terminals 63*a*, 63*a'* and 63*b*, 63*b'* such that the fuses are connected in series between male plug terminal 57*a* and its respective power cord P1, and between male power terminal 57*b* and its respective power cord P2, as shown in FIG. 7. Fuse wires 65*a*, 65*a'* and 65*b*, 65*b'* may be connected to the fuse terminals generally as shown in FIG. 5. It will be understood since the ends of the fuse wires are molded in place within plug body 47, substantial strain relief characteristics are provided for the fuse wires. Further, it will be appreciated that with plug body 47 molded in place around the power terminals 57*a*, 57*b*, and the ground terminal 59, and the various power leads P1, P2, the ground lead G, and the fuse leads 65*a*, 65*a'*, 65*b*, 65*b'*, as shown in FIG. 7, the plug assembly 39 is of rugged construction, and the various leads of the plug assembly are not prone to fail during installation or during service.

In accordance with this invention, receptacle 31 is installed in opening 29 merely by inserting the rear end of the receptacle body 101 into opening 29 such that the deformable ramps or barbs 109 thereon on compressed, and until such time as the body 101 is snap-locked in place relative to wall 27 of support body 5. Similarly, cord 41 of plug assembly 39 is inserted through opening 43 in wall 45 of power plug housing 15, and the inclined ramps or barbs 49 on the rear end of the plug housing are compressed. After the barbs have passed through aperture 43, the plug is snap-locked into place relative to square aperture 43, and is positively held against movement. It will be understood that the rear portion of the molded power plug body 47 serves as a strain relief construction for power lead 41. If optional fuses 61*a*, 61*b* are in place within power plug housing 15 as shown in FIGS. 4 and 5, fuse wires 65*a*, 65*a'*, 65*b*, 65*b'* may be connected to their respective fuse terminals 63*a*, 63*a'*, 63*b*, 63*b'*, as shown in FIG. 5.

Referring to FIG. 8, a prior art power hook is indicated in its entirety by reference character 1'. It will be understood that corresponding reference characters in FIG. 8 having corresponding constructions and parts similar to the parts heretofore described in power hook 1 of the present invention are indicated by primed reference characters, and thus will not be described in detail. The primary difference between the prior art power hook 1' and the power hook 1 of the present invention is the difference in construction between receptacle 31' and receptacle plug assembly 39' and plug assembly 39. More specifically, prior receptacle 31' includes a body having receptacle openings and ground receptacle opening therein similar to openings 33*a*, 33*b* and 35 shown on receptacle 31 in FIG. 3. However, the prior receptacle body is held in place relative to wall 27 of support housing 5 by means of a pair of screws (not shown) which are threaded into apertures 151 at the top and bottom of aperture 29' in wall 27' of support housing 5'. Additionally, the power leads P1', P2' and ground lead G' are soldered to respective terminals on the back side of receptacle body 153. As heretofore mentioned, the soldering of the means P1', P2' and G' required considerable time, and these soldered connections were subject to failure during installation and wiring of the power leads and ground to the incoming power lead through power line inlet opening 23' of collar 9'.

Likewise, plug 39' was fixedly held in place by means of a pair of screws 155, and the respective lead wires P1', P2' and G' were soldered to the back face of plug assembly 39'. Any fuse wires were also required to be soldered in place to the respective terminals, requiring even more labor and cost during assembly. These prior fuse wires were also prone to break during wiring of the plug 39' to the fuses and to the power cord 41'.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

I claim:

1. In a power hook for suspending a lighting fixture from an overhead support and for supplying electrical power to said lighting fixture, said power hook comprising a support housing having means for securement of said power hook to said overhead support, said housing having a bottom on which one member of an eye and hook support means is provided for the removable attachment of said lighting fixture to said support housing, said lighting fixture supported from said eye and hook means being substantially universally swivelable so as to assume a generally vertical operating position, a power plug housing removably securable to said support housing without the requirement of tools, said support housing having a female plug receptacle carried thereby facing said power plug housing when said power plug housing is attached to said support housing, said power plug housing having a male power plug carried thereby for being received by said female receptacle in said support housing when said plug housing is secured to said support housing, said male power plug having a flexible power lead connected thereto and also connected to said lighting fixture for supplying power to said lighting fixture, wherein the improvement comprises: said female receptacle having a receptacle body of electrically insulative synthetic resin material, a pair of power leads and a ground lead molded in place within said receptacle body, said receptacle body being at least in part compressible so as to snap-fit into an aperture in said support housing thereby to securely hold said receptacle body in place with respect to said support housing, and said male plug having a male plug body of electrically insulative synthetic resin material, a pair of male terminals, and a ground terminal extending therefrom, said male plug body being of a compressible material for snap-fitting into an aperture of said power plug housing thereby to securely hold said male plug body in place with respect to said power plug housing, said male and ground terminals engage said receptacle for making electrical contract therewith upon securing said power plug housing to said support housing, said power plug housing having fuse means therewithin, and said male plug body having fuse leads integrally molded with and extending sideways from said male plug body for electrically connecting said fuse means with said power leads.

2. In a power hook as set forth in claim 1 wherein said receptacle body and said plug body have inclined ramps thereon which, when inserted through their respective apertures in their respective support housings and plug body housings, at least partially compress and, with the receptacle body and plug body in their desired installed positions, the said ramps at least in part snap back to their original position thereby to aid in holding the plug body and receptacle body in place relative to their respective housings.

* * * * *